US005437906A

United States Patent [19]

Snuggs

[11] Patent Number: 5,437,906

[45] Date of Patent: Aug. 1, 1995

[54] SANITARY TOILET SEAT COVERS

[76] Inventor: Stuart E. Snuggs, 10009 Lakemere, Dallas, Tex. 75238

[21] Appl. No.: 148,318

[22] Filed: Nov. 8, 1993

[51] Int. Cl.[6] ..... A47K 13/00

[52] U.S. Cl. ..... 428/131; 428/66.6; 428/137; 428/76; 428/127; 4/245.1; 4/245.2; 4/244.3; 4/244.2; 4/243.2; 4/245.3; 4/245.4; 4/245.5

[58] Field of Search ..... 428/131, 65, 137, 76, 428/127; 4/245.1, 245.2, 244.3, 244.2, 243.2, 245.3, 245.4, 245.5

[56] References Cited

U.S. PATENT DOCUMENTS

| | | | |
|---|---|---|---|
| 972,269 | 10/1910 | Slough | 4/244.3 |
| 1,186,556 | 6/1916 | Diggle | 4/244.3 |
| 1,304,511 | 5/1919 | Quackenbush | 4/245.3 |
| 1,429,490 | 9/1922 | Crayton | 4/245.3 |
| 1,745,223 | 1/1930 | Light | 4/245.2 |
| 2,093,168 | 9/1937 | Hamer | 4/245.3 |
| 3,316,560 | 5/1967 | Montaldo | 4/245.3 |
| 3,348,243 | 10/1967 | Kelly | 4/244.3 |
| 3,579,669 | 5/1971 | Loewenstein | 4/244.3 |
| 4,359,787 | 11/1982 | Shoji | 4/244.3 |
| 4,806,406 | 2/1989 | Akerman et al. | 4/245.3 |
| 5,107,549 | 4/1992 | Pitts et al. | 4/245.2 |
| 5,172,431 | 12/1992 | Rohde | 4/245.1 |

FOREIGN PATENT DOCUMENTS

| | | | |
|---|---|---|---|
| 2589346 | 5/1987 | France | 4/244.3 |
| 0234829 | 10/1986 | Japan | 4/245.2 |
| 1387994 | 3/1975 | United Kingdom | 4/245.1 |
| 2049758 | 12/1980 | United Kingdom | 4/245.4 |

*Primary Examiner*—William P. Watkins, III
*Attorney, Agent, or Firm*—Harris, Tucker & Hardin

[57] ABSTRACT

A toilet seat cover adapted to substantially enclose a toilet seat is disclosed which allows a user to quickly and easily expose a sanitary surface. The toilet seat cover comprises a base slip cover to conform to the shape and size of a toilet seat thereby providing greater protection, alignment, and security than pad type seat covers. Secondary slip covers supported by the base slip cover provide multiple layers of surfaces that can be exposed as the secondary slip covers are individually removed. Thus, the user can easily and quickly remove the outermost slip cover without disturbing or removing the remaining slip covers to expose the next successive slip cover as a fresh and sanitary surface.

20 Claims, 2 Drawing Sheets

SANITARY TOILET SEAT COVERS

FIELD OF THE INVENTION

The present invention relates to toilet seat covers, and more particularly to a slip cover type toilet seat cover having multiple surfaces arranged in successive layers so that the outermost layer may be removed to expose a fresh and sanitary surface.

BACKGROUND OF THE INVENTION

The problems associated with toilet seat sanitation have long been recognized. Toilet seats contaminated with human waste, bacteria, or viruses created health risks, and the user is often required, especially in public rest rooms, to clean the toilet seat before use. The problem of toilet seat sanitation has been addressed several ways. One approach has been to provide a toilet seat cover that prevents contact between the toilet seat and a user.

Toilet seat covers generally fall into two categories, pads and slip covers. Pad type toilet seat covers are those covers which are placed on the top surface of the toilet seat. The simplest pad type toilet seat cover is an oval shaped piece of material that a user can simply lay on top of the toilet seat. However, pad type toilet seat covers do not have the desirable degree of security and alignment necessary to prevent contact of the toilet seat by a user. Portions of the toilet seat can be exposed if the pads do not match the shape and size of the toilet seat, and pads can be misplaced or moved by a user. Finally, a user can contact the toilet seat when placing or removing pad type toilet seat covers.

Slip cover type toilet seat covers are those covers which slide onto and enclose a toilet seat instead of just resting on the surface. Slip cover type toilet seat covers provide an inherently secure attachment to the toilet seat, and they do not lose their alignment. Also, slip covers more completely enclose or surround the toilet seat, and they tend to conform to the shape and size of the toilet seat. Thus, slip covers provide greater sanitary protection than pad type toilet seat covers. However, slip covers are more difficult to install and remove than pad covers, so a user is more likely to contact the toilet seat. In addition, the added difficulty may cause some users to not install a toilet seat cover.

Several prior devices have attempted to alleviate the problems associated with toilet seat sanitation. For example, U.S. Pat. No. 1,745,223 to Light discloses a slip cover type toilet seat protector made of paper. Each new toilet user must remove any existing slip cover and place a new sanitary cover on the toilet seat. Because of the absorbent nature of paper, a contaminated cover may be difficult and unpleasant to remove.

U.S. Pat. No. 3,579,669 to Loewenstein discloses a package of multi-layered pad type toilet seat covers which can be secured to a toilet seat. Each cover has a tab projecting from the cover whereby the user may grasp the tab to tear away the top most seat cover from the stack. However, if the pads do not match to the shape and size of the toilet seat, a portion of the toilet seat will remain exposed to contamination. In addition, the sides of the pads are not protected from contamination.

U.S. Pat. No. 4,806,406 to Akerman at et. discloses a flat-end oval shaped slip cover for use on conventional toilet seat. As with other slip cover designs, the user must install the slip cover before each use of the toilet, so the user risks contacting the toilet seat.

U.S. Pat. No. 5,107,549 to Pitts at el. discloses a slip cover type toilet seat cover designed to fit over U-shaped toilet seats. The cover is comprised of an elongated tube of biodegradable material with open ends. Again, a user must install the slip cover before each use of the toilet. In addition, the slip cover is stored on a spool next to the commode, so the slip cover material could be contaminated prior to use.

SUMMARY OF THE INVENTION

The present invention relates to a slip cover type toilet seat cover which provides a plurality of sanitary surfaces arranged in successive layers. The toilet seat cover includes a base slip cover having a generally oval cross section to fit over a toilet seat, so the base slip cover conforms to the overall shape of the toilet seat and provides inherent security and alignment. The toilet seat cover also includes a plurality of secondary slip cover surfaces supported by the base slip cover ranging from an innermost secondary slip cover surface next adjacent to the base slip cover to an outermost secondary slip cover surface. Thus, the toilet seat cover provides multiple layers of surfaces ranging from the base slip cover to the outermost secondary slip cover. The secondary slip cover surfaces can be individually removed from the toilet seat cover to expose the next adjacent slip cover surface without disturbing the remaining secondary slip cover surfaces. A tab extending from the outermost slip cover surface allows a user to quickly remove the outermost secondary slip cover without inadvertently removing additional slip cover surfaces.

The base slip cover can have a substantially annular shape that can be used on oval and U-shaped toilet seats, or it can have a substantially tubular shape for use only on U-shaped toilet seats. Preferably, the secondary slip cover surfaces are additional slip covers with a generally oval cross section arranged in a coaxial configuration with the base slip cover. In this configuration, each secondary slip cover surface substantially encloses all successive secondary slip cover surfaces and the base slip cover for maximum protection and security. The toilet seat cover includes one or more openings, so the toilet seat cover can be slidingly installed on a toilet Seat.

Because the toilet seat cover is a slip cover type toilet seat cover, it substantially encloses the toilet seat to provide superior protection, and it conforms to the size and shape of the toilet seat providing inherent alignment and security not found in pad designs. Because the toilet seat cover has multiple layers, the outermost secondary slip cover surface substantially covers the inner slip covers to ensure they remain clean and sanitary, and a user can obtain a clean and sanitary surface without having to install a new cover.

BRIEF DESCRIPTION OF THE DRAWINGS

For a more complete understanding of the present invention, and for further details and advantages thereof, reference is now made to the following detailed description taken in conjunction with the following drawings, in which.

DETAILED DESCRIPTION OF THE DRAWINGS

The present invention relates to a slip cover type toilet seat cover having multiple layers of sanitary surfaces disposed on a base slip cover. Therefore, removal of the outermost layer exposes the next successive layer as a fresh and sanitary surface, so a user is not required to install a new slip cover.

Figure 1:
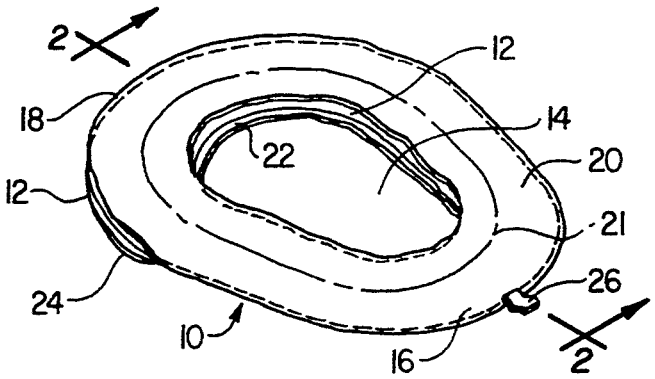
FIG. 1 is a perspective view of a toilet seat cover constructed in accordance with the present invention that is positioned on a standard toilet seat.

FIG. 1 is a perspective view of toilet seat cover 10 as installed on toilet seat 12. Toilet seat 12 is a standard oval shaped toilet seat defining toilet seat opening 14. The front portion of toilet seat 12 is referred to as 16 and the rear portion is referred to as 18. Rear portion 18 can be hinged to a toilet in the usual manner. Slip cover 20 is coaxially arranged to enclose the inner slip covers and toilet seat 12 around axis 21 which has a substantially oval shape. Slip cover 20 includes openings 22 and 24 and tab 26.

Figure 2:
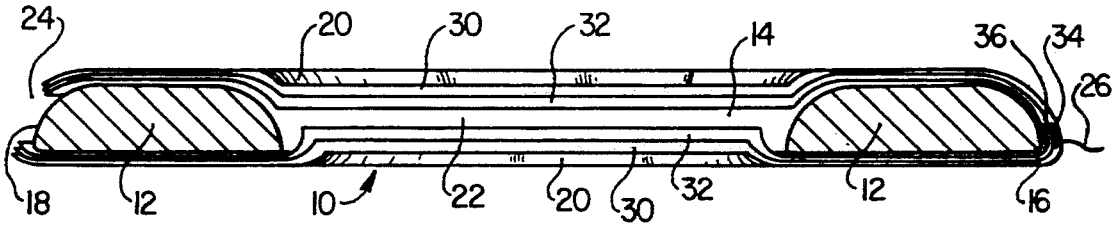
FIG. 2 is a sectional view of a toilet seat cover taken along line 2—2 of FIG. 1.

FIG. 2 is a cross sectional view of toilet seat cover 10 and toilet seat 12 taken along line 2—2 of FIG. 1. Slip covers 20, 30, and 32 are represented as having a thickness of a single line. Toilet seat cover 10 includes slip cover 20 coaxially arranged to enclose slip covers 30 and 32, and slip cover 30 is coaxially arranged to enclose slip cover 32. Toilet seat cover 10 is coaxially arranged to enclose toilet seat 12. Slip covers 30 and 32 include tabs 34 and 36 respectively, and both slip covers 30 and 32 have openings 22 and 24.

Figure 3:
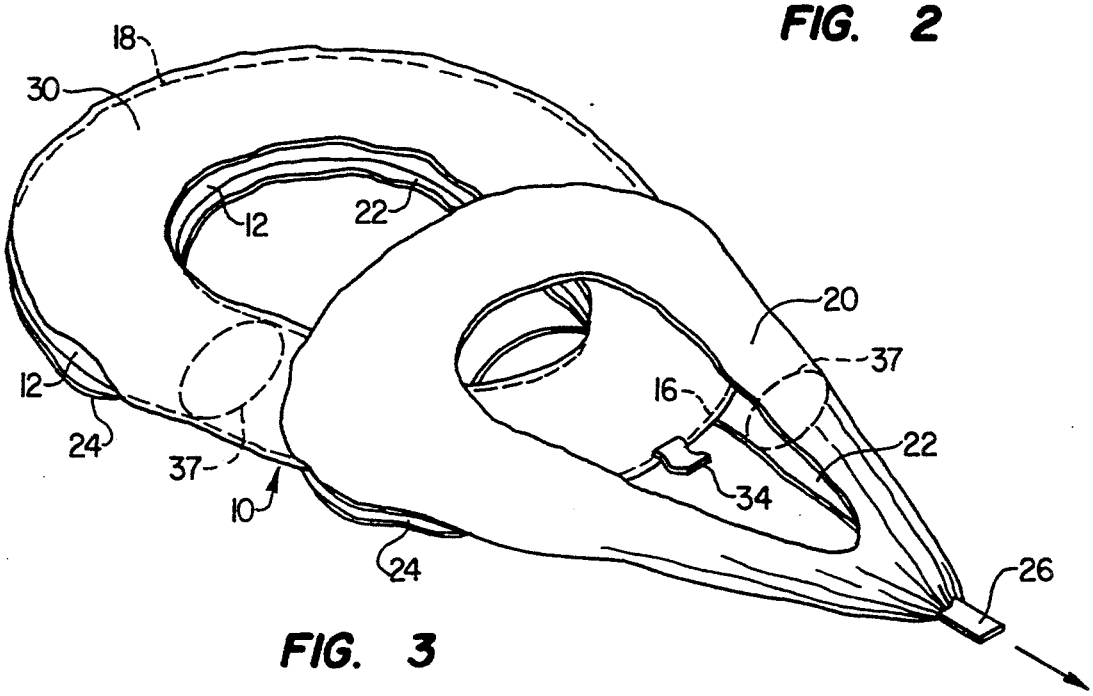
FIG. 3 is a perspective view of the toilet seat cover as shown in FIG. 1 demonstrating how the outermost slip cover layer can be removed.

FIG. 3 is a perspective view of toilet seat cover 10 as shown in FIG. 1 with slip cover 20 partially removed. Slip cover 20 can be individually removed from the toilet seat cover 10 by pulling tab 26 as shown, but toilet seat cover 10 remains on toilet seat 12 with slip covers 30 and 32 undisturbed. Slip cover 30 is exposed as a fresh and sanitary surface as slip cover 20 is removed from toilet seat cover 10. Tab 34 extending from slip cover 30 is also exposed as slip cover 20 is removed.

Toilet seat cover 10 engages and protects toilet seat 12 by enclosing the annular portion of the toilet seat which defines the toilet seat opening 14 with a base slip cover 32 having a generally oval cross-section shape 37 to substantially enclose toilet seat 12. Thus toilet seat cover 10 is a slip cover type toilet seat cover, so it conforms to variations in size and shape found in toilet seat 12. Moreover, toilet seat cover 10 encloses toilet seat 12 to provide inherently secure protection that cannot be misaligned or inadvertently moved by a user.

Secondary slip covers 20 and 30 provide successive layers of sanitary surfaces, with the outermost secondary slip cover 20 protecting the successive layers of inner slip covers 30 and 32 from contamination. The successive layers of protective surfaces created by slip covers 20, 30 and 32 alleviate the need for a user to install a new slip cover; instead, the user only needs to remove the outermost slip cover 20 to expose slip cover 30 as a clean and sanitary surface. Therefore, the user is much less likely to contact the toilet seat.

Many of the benefits derived from slip cover type toilet seat covers can be provided by base slip cover 32, so secondary slip covers 20 and 30 need not fully enclose the base slip cover 32. The secondary slip covers 20 and 30 only need to be supported by base slip cover 32 in a configuration that provides successive layers of sanitary surfaces in a manner that allows the outermost secondary slip cover to be individually removed from toilet seat cover 10. Preferably, the slip covers 20, 30, and 32 share a common shape with a generally oval cross section 37, and they are disposed in a substantially coaxial relationship around a common axis of symmetry 21. In this configuration, each layer of toilet seat cover 10 is securely aligned with toilet seat 12, and all inner layers remain clean and sanitary. The same axis of symmetry 21 is the axis of the annular portion of toilet seat 12. However, secondary slip covers that do not enclose base slip cover 32 can be removably supported on the base slip cover by straps, adhesive, or any other means known in the art. In particular, the secondary slip covers can be integrally formed with the base slip cover.

In a first embodiment shown in FIGS. 1–3, toilet seat cover 10 has a substantially annular shape that conforms to the shape of oval toilet seat 12, but toilet seat cover 10 can also be used on U-shaped toilet seats. The annular shape creates an outer circumference and an inner circumference. Opening 22 extends completely around the inner circumference, and opening 24 extends along the outer circumference along rear portion 18 of toilet seat 12. Openings 22 and 24 allow the toilet seat cover 10 to be slidingly installed on toilet seat 12 by initially sliding opening 24 of toilet seat cover 10 over front portion 16 of toilet seat 12. Then, toilet seat cover 10 can be slidingly moved toward rear portion 18 of toilet seat 12 until toilet seat cover 10 is in a substantially coaxial relationship with toilet seat 12 with respect to axis 21. Openings 22 and 24 also allow slip covers 20, 30 and 32 to be individually removed from toilet seat 12.

Toilet seat cover 10 also includes a means for removably supporting the secondary slip covers on the base slip cover in a manner that permits each of the slip covers to be individually removed. Preferably, the individual slip covers 20, 30, and 32 are not connected to one another in any way, and secondary slip covers 20 and 30 are held in place only because they enclose base slip cover 32. Thus, outermost slip cover 20 can be slidingly removed from toilet seat cover 10, and openings 22 and 24 allow slip cover 20 to be removed without disturbing or removing slip covers 30 and 32. Alternatively, the secondary slip covers could be manufactured with a weakened seam or other portion that allows the outermost slip cover to be torn away from the toilet seat cover 10. If some means other than enclosure of the base slip cover is used to removably support the secondary slip covers on the base slip cover, the means must allow the outermost slip cover to be removed without removing or disturbing the remaining slip covers.

Tab 26 allows the user to grasp only outermost slip cover 20 without inadvertently grasping additional slip covers. Tab 26 of outer most slip cover 20 is exposed, but tabs 34 and 36 of the inner slip covers 30 and 32 are enclosed. Preferably, tab 26 is integrally formed with slip cover 20. Alternatively, it can be an added feature, or a cut on the surface of slip cover 20 that causes a tab-like piece of material to extend from the slip cover. Other means for removing only the outermost slip cover include a raised seam running along the outer portion of slip cover 20, a small string or thread, or a device that a user can utilize to grasp only the outermost slip cover. In addition, a portion of the outermost slip cover could have a textured or adhesive surface that would allow a user to easily grasp the slip cover. Preferably, each slip cover has only one tab, but more than one tab may be used. In addition, the tab is preferably positioned on the front portion of toilet seat cover 10, so the slip cover can be removed easily by pulling the tab away from the toilet seat cover 10. If opening 24 is on a different portion of toilet seat 10, tab 26 should be in a position substantially opposite from opening 24.

Slip covers 20, 30, and 32 can be constructed in a manner or of a material that causes the slip covers to maintain their generally oval cross section 37 so that openings 22 and 24 remain substantially closed. In addition, the top edge of openings 22 and 24 can overlap or overhang the bottom edge of the openings to protect the inner layers of slip covers from contamination. Openings 22 and 24 can be resealed by some means after toilet seat cover 10 is installed on toilet seat 12 for added security and protection, but the outermost slip cover must remain individually removable.

Toilet seat cover 10 is constructed of thin flexible material that is preferably nonabsorbent. In addition, the material must have a low coefficient of friction between the individual slip covers so that the outermost slip cover 20 can be slidingly removed from toilet seat cover 10 without disturbing or removing the remaining slip covers 30 and 32. Commercially available plastic material has been found to be suitable. Toilet seat cover 10 is dimensioned to engage and enclose a toilet seat, but it does not block or cover toilet seat opening 14. Some toilet seats have one or more protruding foot portions that support the toilet seat on the rim of the toilet bowl, so toilet seat cover 10 is dimensioned to substantially enclose toilet seat 12, including the protruding foot portions. The foot portions do not hinder the sliding removal of the outermost slip cover 20 unless some force or weight is applied to the toilet seat.

Rear portion 18 of toilet seat 12 can be hingedly attached to a toilet bowl, so toilet seat cover 10 includes a slot or groove to receive the hinges. Alternatively, toilet seat cover 10 can simply be compressed below toilet seat 12 by the hinges. Openings 22 and 24 prevent the compression of toilet seat cover 10 below toilet seat 12 from affecting the exposed surface of the outermost slip cover 20, and top surface of outermost slip cover 20 will lay flat and smooth across the top of back portion 18 of toilet seat 12.

Toilet seat cover 10 preferably includes from twenty to fifty individual slip covers, having a generally oval cross sections 37, and manufactured or arranged in a substantially coaxial relationship. Preferably, each of the individual slip covers have essentially the same dimensions, but they can be coaxially arranged because they are constructed of such thin material. Alternatively, the slip covers can be manufactured with slightly increasing dimensions. Without opening 22, toilet seat cover 10 can still be used on a U-shaped toilet seat.

Figure 4:
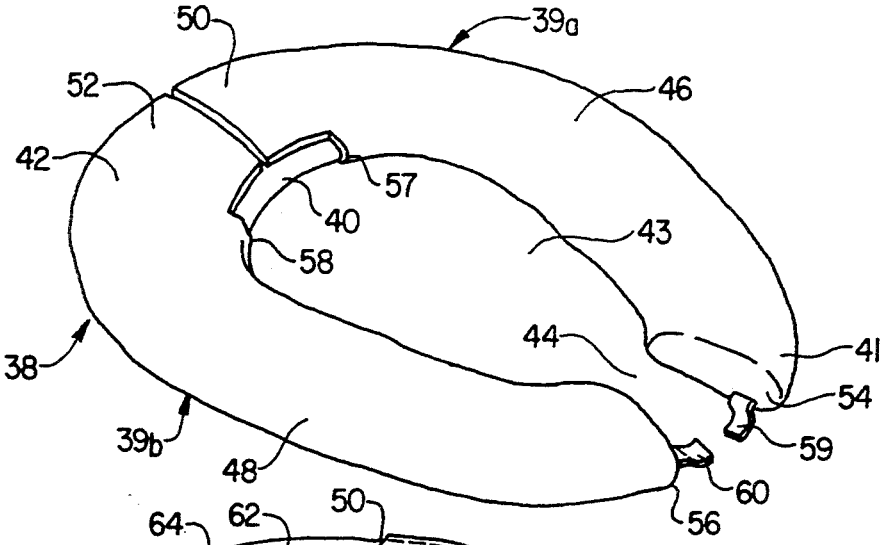
FIG. 4 is a perspective view of an alternative embodiment of the present invention for use on U-shaped toilet seats.

Referring now to FIG. 4, toilet seat cover 38 includes slip cover assemblies **39*a* and 39*b* that are installed on U-shaped toilet seat 40, also known as a horse-shoe shaped toilet seat. The front portion of toilet seat 40 is referred to as 41, and the rear portion is referred to as 42. The rear portion 42 can be hingedly attached to a toilet in the usual manner. U-shaped toilet seat 40 has two extending arms which define toilet seat opening 43 and front space 44. Secondary slip cover surfaces 46 and 48 are arranged to substantially cover inner slip cover surfaces and toilet seat 40. Slip cover assemblies 39*a* and 39*b* have flaps 50 and 52 respectively to cover the rear portion 42 of toilet seat 40. End portions 54 and 56 of slip cover assemblies 39*a* and 39b are closed, but end portions 57 and 58 are substantially open. Slip cover surfaces 46 and 48 also have tabs 59 and 60** respectively.

Figure 5:
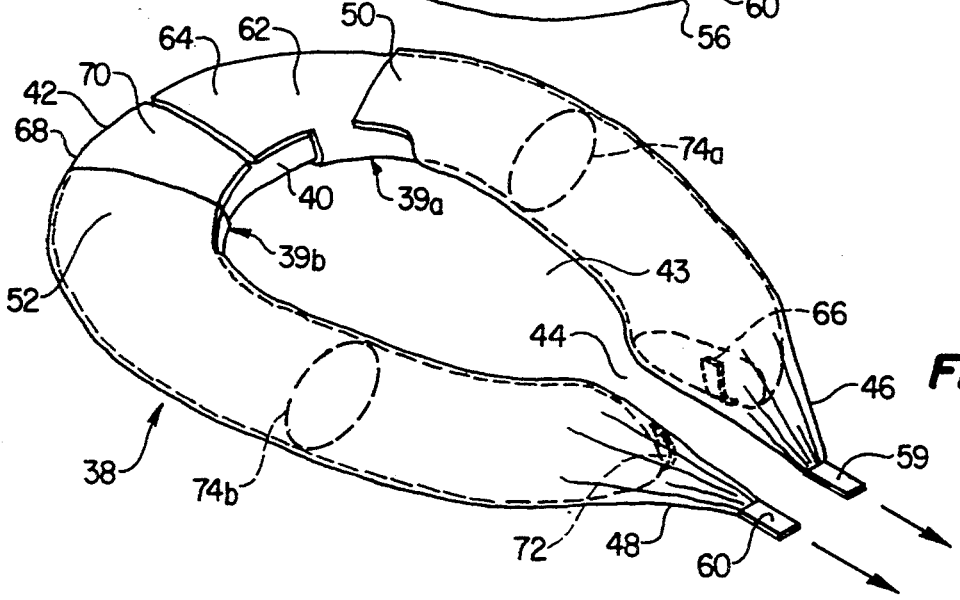
FIG. 5 is a perspective view of the toilet seat cover as shown in FIG. 4 demonstrating how the outermost slip cover layers can be removed.

FIG. 5 is a perspective view of the toilet seat cover 38 as shown in FIG. 4 with outermost slip cover surfaces 46 and 48 partially removed from slip cover assemblies **39*a* and 39*b* as tabs 59 and 60 are pulled away from toilet seat cover 38. As slip cover surfaces 46 and 48 are removed, slip cover 62 with tab 66 is exposed on slip cover assembly 39*a*, and slip cover 68 with tab 72 is exposed on slip cover assembly 39*b*. Flaps 64 and 70 cover rear portion 42 of toilet seat 40**.

Toilet seat cover 38 is an alternative embodiment of the multilayered slip cover type toilet seat cover described above that is intended for use only on U-shaped toilet seat 40 having opening 44 along front portion 41. Toilet seat cover 38 includes two cooperating slip cover assemblies **39*a* and 39*b*. Slip cover assembly 39*a* includes a base slip cover (not shown) having a generally oval cross-section 74a and tubular shape that can fit one arm of toilet seat 40. Secondary slip covers 46 and 62 provide successive layers of sanitary surfaces. Outermost secondary slip cover 46 protects the successive layers of slip covers from contamination. Slip cover assembly 39*b* is substantially similar to slip cover assembly 39*a* with a base slip cover (not shown) having a generally oval cross-section 74b. Thus, toilet seat cover 38 and slip cover assemblies 39*a* and 39*b* are slip cover type toilet seat covers sharing most of the characteristics and features of toilet seat cover 10. For example, toilet seat cover 38 and slip cover assembles 39*a* and 39*b* are preferably constructed of non-absorbent, low-friction material with twenty to fifty protective layers. In addition, the means for removably supporting the secondary slip covers on the base slip cover and the use of tabs to remove the outermost slip cover are also similar. Toilet seat covers 10 and 38 both comprise a base slip cover that supports successive slip cover layers that are individually removable, but toilet seat cover 38** has a tubular shape instead of an annular shape.

The secondary slip covers 46, 48, 62 and 68 of toilet seat cover 38 preferably have a substantially tubular shape, and they are preferably disposed in a substantially coaxial relationship with the base slip covers. This means for supporting the secondary slip covers on the base slip cover provides enhanced security and alignment, and the outermost slip cover can be slidingly removed from the remaining slip covers because the adjacent slip covers are not attached to one another. However, the secondary slip covers need not fully enclose the base slip cover. The base slip covers of slip cover assemblies **39*a* and 39*b* provide the alignment and attachment of toilet seat cover 38 to toilet seat 40, and the secondary slip covers are also aligned with toilet seat 40** because they are supported by the base slip cover. Other means for supporting the secondary slip covers on the base slip cover include tear-away seams, adhesives, straps, and the like. The means for supporting the secondary slip covers on the base slip covers must allow the outermost secondary slip covers to be progressively removed to expose successive layers of sanitary surfaces.

Slip cover assembly 39*a* has open end portion 57 and closed end portion 54, and slip cover assembly 39*a* can be installed on toilet seat 40 by sliding open end 57 over one arm of toilet seat 40, and then sliding slip cover assembly 39*a* onto toilet seat 40 until closed end portion 54 reaches front portion 41 of the arm. Slip cover 46 can be individually removed from toilet seat 40 by pulling tab 59 away from toilet seat 40. Slip cover assembly 39*b* can be installed in a manner similar to slip cover assembly 39*a*, and slip cover 48 can be removed in a manner similar to slip cover 46.

Rear portion 42 of toilet seat 40 is hingedly attached to a toilet, so slip cover assemblies 39*a* and 39*b* preferably do not extend to the midpoint of rear portion 42 of toilet seat 40. Flaps 50 and 52 extend from open ends 57 and 58 of slip cover assemblies 39*a* and 39*b* respectively, to cover the top surface of toilet seat 40 along rear portion 42. More preferably, each successive layer of secondary slip covers includes a flap to cover the top surface of toilet seat 40 along rear portion 42. Alternatively, slip cover assemblies 39*a* and 39*b* extend to the midpoint of rear portion 42 of toilet seat 40, and the slip cover assemblies 39*a* and 39*b* each have a slot or groove which can receive the hinges.

Toilet seat cover assemblies 39*a* and 39*b* have an elongated tubular shape with a generally oval cross-section shape 74*a* and 74*b*. The tubular shape can be molded as a straight tube that bends to conform to toilet seat 40, or it can be molded with a slight curve to better conform to the curvature of toilet seat 40. End portion 54 of slip cover assembly 39*a* and end portion 56 of slip cover assembly 39*b* are preferably closed, but these end portions could be left open without materially effecting the present invention.

Figure 6:
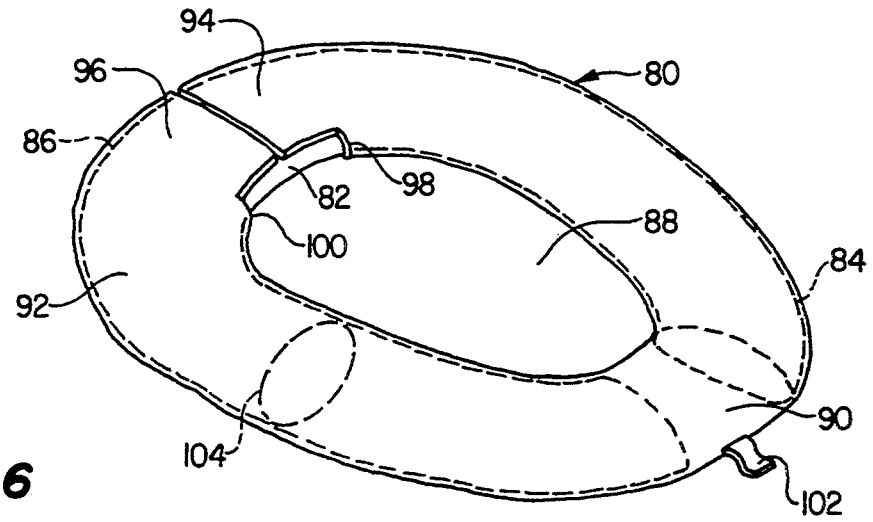
FIG. 6 is a perspective view of a second alternative embodiment of the present invention for use on U-shaped toilet seats.

FIG. 6 is a perspective view of toilet seat cover 80 which is a multi-layered toilet seat cover for use on U-shaped toilet seat 82. The front portion of toilet seat 82 is referred to as 84, and the rear portion is referred to as 86. The rear portion 86 can be hinged to a toilet in the usual manner. Toilet seat 82 has two extending arms which define toilet seat opening 88 and front space 90. Slip cover surface 92 is arranged to substantially cover inner slip cover surfaces and toilet seat 82. Toilet seat cover 80 has flaps 94 and 96 extending from the open ends 98 and 100 to cover the rear portion 86 of toilet seat 82. Tab 102 extends from slip cover surface 92.

Toilet seat cover 80 is an alternative embodiment of the multilayered slip cover type toilet seat cover described above that is intended for use only on U-shaped toilet seat 82 having front space 90 along front portion 84. Toilet seat cover 80 includes a base slip cover (not shown) having a generally oval cross-section 104 and tubular shape that can fit over both arms of toilet seat 82. Secondary slip covers provide successive layers of sanitary surfaces terminating with outermost slip cover 92. Thus, toilet seat cover 80 is a slip cover type toilet seat cover sharing most of the characteristics and features of toilet seat covers 10 and 38. For example, toilet seat cover 80 is preferably constructed of non-absorbent, low-friction material with twenty to fifty protective layers. In addition, the means for removably supporting the secondary slip covers on the base slip cover and the use of tabs on toilet seat cover 80 are also similar to toilet seat covers 10 and 38. Toilet seat covers 10, 38 and 80 each comprise a base slip cover that supports successive slip cover layers that are individually removable. However, toilet seat cover 80 has a tubular shape instead of the annular shape of toilet seat cover 10, and toilet seat cover 80 covers both arms of toilet seat 82.

Toilet seat cover 80 includes a base slip cover (not shown) having a generally oval cross section 104 to fit over both arms of toilet seat 82 and a plurality of secondary slip covers arranged to protect the other secondary slip covers from contamination. The secondary slip covers are removably supported by the base slip cover in a manner that allows the secondary slip covers to be progressively removed to expose the next successive sanitary surface. Preferably, the individual slip covers are not connected to one another, and they are held in place only because they enclose the base slip cover. Thus, outermost slip cover 92 can be slidingly removed from toilet seat cover 80.

Toilet seat cover 80 has open end portions 98 and 100, and toilet seat cover 80 can be installed on toilet seat 82 by first sliding open end portion 98 over the first arm of toilet seat 82, and then sliding toilet seat cover 80 onto the first arm of toilet seat 82 until open end portion 98 is at rear portion 86 of toilet seat 82. Then, toilet seat cover 80 is installed on the second arm of toilet seat 82 by sliding open end portion 100 over the second arm of toilet seat cover 80, and then sliding toilet seat cover 80 onto the second arm until open end portion 100 is at rear portion 86. Outermost slip cover 92 can be individually removed from toilet seat 82 or toilet seat cover 80 by pulling tab 102 away from front portion 84 of toilet seat 82.

Toilet seat 82 is hingedly attached to a toilet, so toilet seat cover 80 preferably does not extend to the midpoint of rear portion 86 of toilet seat 82, and flaps 94 and 96 extend from open end portions 98 and 100 of toilet seat cover 80 to cover the top surface of toilet seat 82 along rear portion 86. More preferably, flaps 94 and 96 extend from the outermost slip cover, so fresh and sanitary flaps are exposed each time a secondary slip cover is removed. Alternatively, toilet seat cover 80 extends to the midpoint of rear portion 86 of toilet seat 82, and slots or grooves in toilet seat cover 80 receive the hinges.

Other improvements can be made on the present invention without altering the scope of the patent. For example, a disinfectant can be present between each successive layer of slip covers of toilet seat covers 10, 38 and 88 so that a user is assured that each new slip cover is fresh and sanitary. A light powder can be used to reduce or eliminate the friction between adjacent slip covers, and a perfume or scented material can be used to mask any unpleasant odors.

Although preferred embodiments of the invention have been described in the foregoing detailed description and illustrated in the accompanying drawings, it will be understood that the invention is not limited to the embodiments disclosed but is capable of numerous rearrangements, modifications and substitutions of parts and elements without departing from the spirit of the invention. Accordingly, the present invention is intended to encompass such rearrangements, modifications and substitutions of parts or elements as fall within the scope of the invention.

I claim:

1. A toilet seat cover adapted to substantially enclose a toilet seat in such a way that allows a user to quickly and easily expose a sanitary surface, said toilet seat having a top surface and a bottom surface, comprising:

a base slip cover, having a protective surface, configured to provide a generally oval cross section adapted to fit over a toilet seat;

a plurality of secondary slip covers removably supported on the base slip cover in a configuration providing a plurality of protective surfaces ranging from an innermost protective surface provided by the secondary slip cover next adjacent to the base slip cover to an outermost protective surface provided by the outermost of the secondary slip covers; and means for removably supporting the secondary slip covers on the base slip cover in a manner permitting each of the secondary slip covers to be progressively removed to expose the next succeeding protective surface wherein said secondary slip covers are not connected to one another in anyway, and wherein the protective surface of said base slip cover and the plurality of protective surfaces provided by said secondary slip covers are adapted to substantially cover both said top surface and said bottom surface of said toilet seat.

2. The toilet seat cover of claim 1, wherein the means for removably supporting the plurality of secondary slip covers comprises:

integrally formed secondary slip covers having generally oval cross sections, each secondary slip cover substantially enclosing the next adjacent underlying slip cover; and at least one opening in each secondary slip cover whereby the outermost secondary slip cover can be slidingly removed.

3. The toilet seat cover of claim 1, further comprising a means for removing the outermost of the secondary slip covers from the plurality of secondary slip covers.

4. The toilet seat cover of claim 3, wherein the means for removing the outermost of the secondary slip covers from the plurality of the secondary slip covers is at least one tab attached to the outermost of the secondary slip covers.

5. The toilet seat cover of claim 1, wherein the base slip cover has an annular shape with an outer circumference and an inner circumference.

6. The toilet seat cover of claim 5, wherein the base slip cover has at least one opening on the inner circumference and at least one opening on the outer circumference whereby the toilet seat cover can slidingly engage a toilet seat.

7. The toilet seat cover of claim 1, wherein the base slip cover has a substantially tubular configuration with oppositely disposed first and second end portions.

8. The toilet seat cover of claim 7, wherein the first end portion of the base slip cover is substantially open whereby the toilet seat cover can slidingly engage one arm of a U-shaped toilet seat.

9. The toilet seat cover of claim 7, wherein the first and second end portions are substantially open whereby the toilet seat cover can slidingly engage both arms of a U-shaped toilet seat.

10. A toilet seat cover adapted to substantially enclose a toilet seat in such a way that allows a user to quickly and easily expose a sanitary surface, said toilet seat having a top surface and a bottom surface, comprising:

a base slip cover, having a protective surface, configured to provide a generally oval cross section adapted to substantially enclose a toilet seat;

a plurality of secondary slip covers, each having a protective surface, supported on the base slip cover, each slip cover configured to provide a generally oval cross section adapted to substantially enclose the base slip cover in a substantially coaxial manner whereby the base slip cover is substantially enclosed by successive adjacent layers of secondary slip covers terminating with an outermost slip cover; and means for removably supporting the secondary slip covers on the base slip cover in a manner permitting each of the secondary slip covers to be progressively removed to expose the next succeeding protective surface wherein said secondary slip covers are not connected to one another in anyway, and wherein the protective surface of said base slip cover and the plurality of protective surfaces provided by said secondary slip covers are adapted to substantially cover both said top surface and said bottom surface of said toilet seat.

11. The toilet seat cover of claim 10 wherein the means for removably supporting the secondary slip covers on the base slip cover comprises at least one opening on each secondary slip cover so that the outermost secondary slip cover can be slidingly removed.

12. The toilet seat cover of claim 10, further comprising at least one tab attached to the outermost of the secondary slip covers.

13. The toilet seat cover of claim 11, wherein each slip cover has an annular shape with an outer circumference and an inner circumference, the outer circumference forming the at least one opening on each secondary slip cover.

14. The toilet seat cover of claim 11, wherein the base slip cover has a substantially tubular configuration with oppositely disposed first and second end portions, the first end portion of each secondary slip cover forming the at least one opening on each secondary slip cover.

15. A toilet seat cover adapted to allow a user to quickly and easily expose a sanitary surface, comprising:

a base slip cover, having a protective surface, supported on a toilet seat, said toilet seat having a top surface and a bottom surface, the base slip cover configured to provide a generally oval cross section substantially enclosing a toilet seat;

a plurality of secondary slip covers supported on the base slip cover; and means for removably supporting the plurality of secondary slip covers on the base slip cover in a configuration providing a plurality of protective surfaces ranging from an innermost protective surface provided by the base slip cover to an outermost protective surface provided by the outermost of the secondary slip covers, the means for removably supporting the plurality of secondary slip covers permitting each of the secondary slip covers to be progressively removed to expose the next succeeding protective surface wherein said secondary slip covers are not connected to one another in anyway, and wherein the protective surface of said base slip cover and the plurality of protective surfaces provided by said secondary slip covers are adapted to substantially cover both said top surface and said bottom surface of said toilet seat.

16. The toilet seat cover of claim 15, wherein each of the plurality of secondary slip covers has a generally oval cross section, each of the secondary slip covers configured to substantially enclose the base slip cover in a substantially coaxial manner.

17. The toilet seat cover of claim 15, wherein the base slip cover has an annular shape with an outer circumference and an inner circumference.

18. The toilet seat cover of claim 15, wherein:

the base slip cover has a substantially tubular configuration with oppositely disposed first and second end portions.

19. A method of furnishing a toilet seat cover that allows a user to quickly and easily expose a sanitary surface comprising the following steps:

engaging a toilet seat with a base slip cover having a protective surface and a generally oval cross section, said toilet seat having a top surface and a bottom surface;

arranging a plurality of secondary slip covers on the base slip cover in a configuration providing a plurality of protective surfaces ranging from an innermost protective surface provided by the base slip cover to an outermost protective surface provided by the outermost of the secondary slip covers wherein said secondary slip covers are not connected to one another in anyway, and wherein the protective surface of said base slip cover and the plurality of protective surfaces provided by said secondary slip covers are adapted to substantially cover both said top surface and said bottom surface of said toilet seat; and removably supporting the plurality of secondary slip covers on the base slip cover in a configuration permitting each of the secondary slip covers to be progressively removed to expose the next succeeding protective surface.

20. The method of claim 19 including the following steps:

providing a means for removing the outermost slip cover from the plurality of slip covers without inadvertently removing additional slip covers.

* * * * *